US010661588B2

(12) United States Patent
Tachihara

(10) Patent No.: US 10,661,588 B2
(45) Date of Patent: May 26, 2020

(54) IMAGE FORMING APPARATUS

(71) Applicant: CANON FINETECH NISCA INC., Misato-shi (JP)

(72) Inventor: Yuji Tachihara, Nagareyama (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 16/228,825

(22) Filed: Dec. 21, 2018

(65) Prior Publication Data

US 2019/0193442 A1 Jun. 27, 2019

(30) Foreign Application Priority Data

Dec. 26, 2017 (JP) ..... 2017-249531
Dec. 19, 2018 (JP) ..... 2018-237720

(51) Int. Cl.

| | |
|---|---|
| ***B41J 29/58*** | (2006.01) |
| ***B41J 19/20*** | (2006.01) |
| ***B41J 2/01*** | (2006.01) |
| ***B41J 25/34*** | (2006.01) |
| ***B41J 25/00*** | (2006.01) |
| ***B41J 29/02*** | (2006.01) |
| ***B41J 19/14*** | (2006.01) |
| *B41J 29/38* | (2006.01) |

(52) U.S. Cl.

CPC ..... *B41J 29/58* (2013.01); *B41J 2/01* (2013.01); *B41J 19/142* (2013.01); *B41J 19/207* (2013.01); *B41J 25/001* (2013.01); *B41J 25/34* (2013.01); *B41J 29/02* (2013.01); *B41J 29/38* (2013.01)

(58) Field of Classification Search

CPC ... B41J 29/58; B41J 2/01; B41J 19/207; B41J 25/34; B41J 29/38

See application file for complete search history.

(56) References Cited

U.S. PATENT DOCUMENTS 5,598,192 A * 1/1997 Burger ..... B41J 25/001 347/40
6,022,091 A * 2/2000 Uchikata ..... B41J 2/16538 347/37
8,172,350 B2 * 5/2012 Okuda ..... B41J 25/3082 347/37

FOREIGN PATENT DOCUMENTS

JP 10-16302 A 1/1998

* cited by examiner

*Primary Examiner* — Thinh H Nguyen
(74) *Attorney, Agent, or Firm* — Venable LLP

(57) ABSTRACT

An image forming apparatus includes a carriage which is movably provided in a main scanning direction, a sub-carriage which is movably supported in a sub-scanning direction substantially orthogonal to the main scanning direction with respect to the carriage and performs recording on a recording medium from a held recording head, and a biasing member which is attached to a locking portion of the carriage and a locking portion of the sub-carriage and applies a force to the sub-carriage with respect to the carriage in three directions of the main scanning direction (first direction), the sub-scanning direction (second direction), and a vertical direction (third direction) substantially orthogonal to the main scanning direction and the sub-scanning direction.

8 Claims, 12 Drawing Sheets

IMAGE FORMING APPARATUS

BACKGROUND OF THE INVENTION

Field of the Invention

The present invention relates to an image forming apparatus which make a scanning unit equipped with a recording head perform reciprocal scanning so as to perform recording on a recording medium.

Description of the Related Art

Generally, in a printer apparatus as an image forming apparatus which performs recording on a recording medium by reciprocal scanning of a scanning unit, there is a system for using a recording head having a narrow recording area for recording at a low cost. At that time, there is a printer apparatus which is configured to be able to move a sub-carriage holding a recording head in a carriage of the reciprocating scanning unit so that the recording head is shifted in a sub-scanning direction orthogonal to a main scanning direction before backward scanning and after forward scanning and is then subjected to the backward scanning to thereby achieve a predetermined purpose without moving the recording medium.

For example, Japanese Patent Laid-Open No. H10-16302 discloses a configuration in which the sub-carriage is configured to be movable in a sub-scanning direction by a predetermined distance using a groove of a plate member within the carriage, and the plate member abuts on a side wall of a printer body to shift a head position.

However, in No. H10-16302, since the sub-carriage is movably held in the sub-scanning direction orthogonal to the main scanning direction with respect to the carriage, there is a gap between the sub-carriage and the carriage. There is a problem in that the sub-carriage equipped with the recording head is rattled within the carriage due to the gap due to a speed change when the carriage which has been moving at high speed is suddenly stopped, reversed, and then rapidly accelerated and the recording accuracy deteriorates due to the rattling of the recording head.

SUMMARY OF THE INVENTION

An image forming apparatus of the present invention includes:

a recording head which performs recording on a recording medium by ejecting a liquid to the recording medium;

a carriage which moves the recording head in a first direction by reciprocating in the first direction; and a holding unit which detachably holds the recording head, wherein the holding unit is supported by the carriage, and the holding unit is moved in a second direction substantially orthogonal to the first direction while being supported by the carriage to move the recording head between a first position and a second position different from the first position, the holding unit and the recording head is movable in the first direction together with the carriage, the recording head ejects a liquid to the recording medium in a state in which the recording head is positioned at the first position and in a state in which the carriage is moved in the first direction so as to perform the recording on the recording medium, the recording head ejects a liquid to the recording medium in a state in which the recording head is positioned at the second position and in a state in which the carriage is moved in the first direction so as to perform the recording on the recording medium, a biasing member which applies a force to the holding unit supported by the carriage in a predetermined direction with respect to the carriage so as to position the holding unit, a first locking portion which is provided on the holding unit to lock one end portion of the biasing member, a second locking portion which is provided on the carriage to lock the other end portion of the biasing member, the second locking portion are at different positions from the first locking portion in the first direction, the second direction, and a third direction, and the third direction is substantially orthogonal to the first direction and the second direction.

Further features of the present invention will become apparent from the following description of exemplary embodiments with reference to the attached drawings.

DESCRIPTION OF THE EMBODIMENTS

Exemplary embodiments of the present invention will be described in detail below with reference to the accompanying drawings. However, dimensions, materials, and shapes of components described in the following embodiments, relative positions thereof, and the like should be appropriately changed depending on a configuration of an apparatus to which the present invention is applied or various conditions. Therefore, unless otherwise specified, the scope of the present invention is not limited thereto/

First Embodiment

An image forming apparatus according to the present embodiment will be described with reference to FIGS. 1 to 10. The image forming apparatus according to the present embodiment is an image forming apparatus which performs recording on a recording medium while reciprocating a carriage, and here, a printer apparatus will be described as an example.

Figure 1:
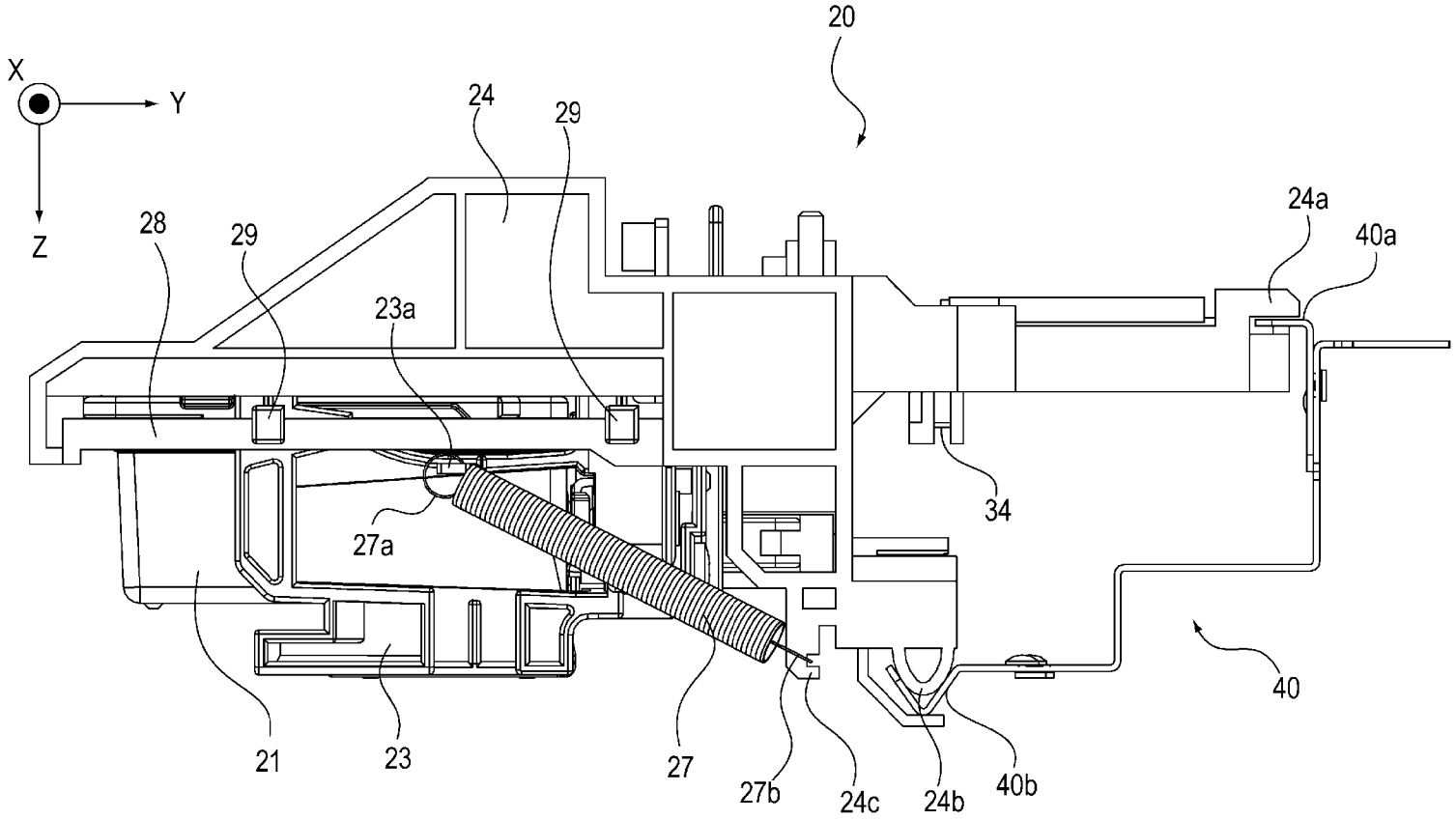
FIG. 1 is a side view of a scanning unit in a printer apparatus.
Figure 2:
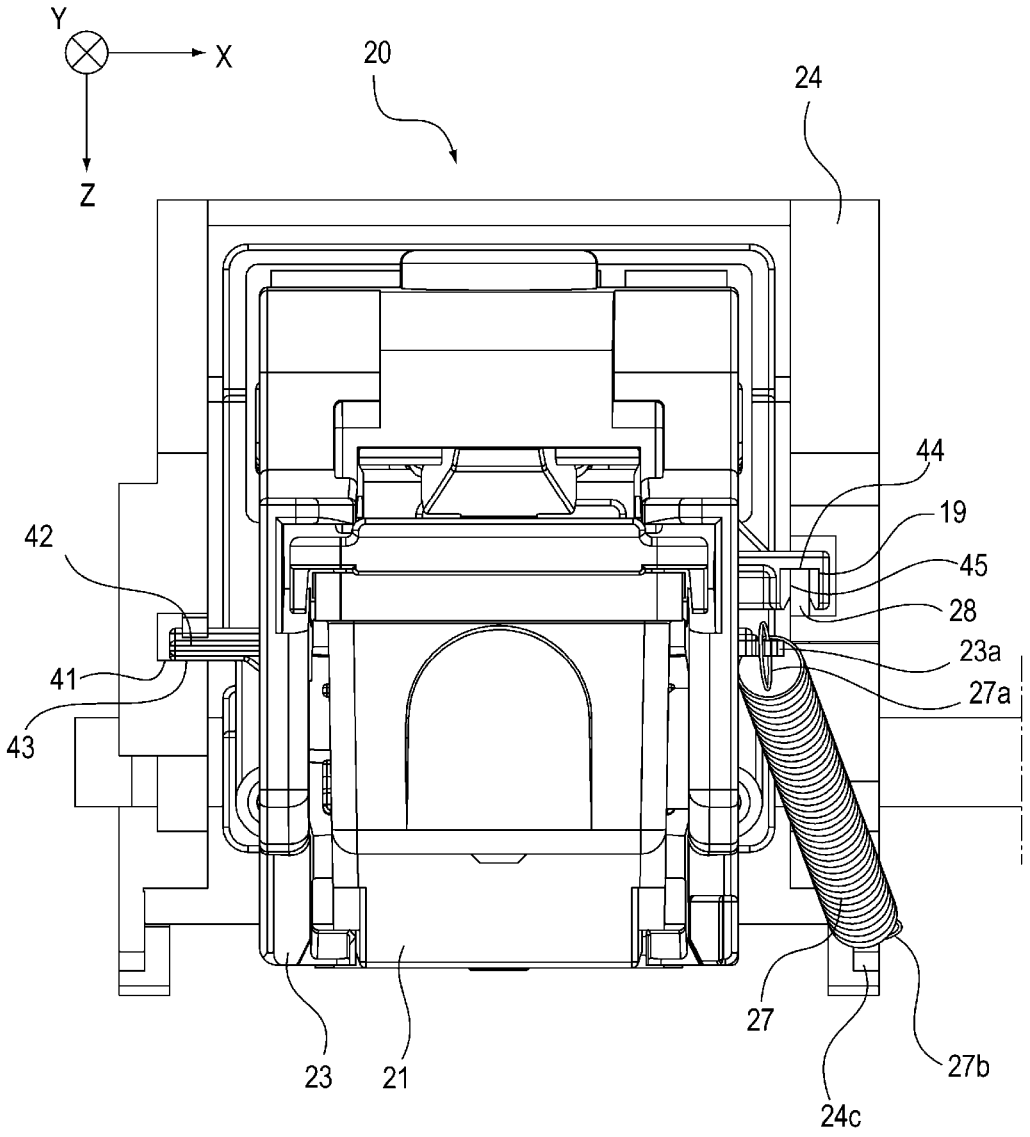
FIG. 2 is a front view of the scanning unit in the printer apparatus.
Figure 3:
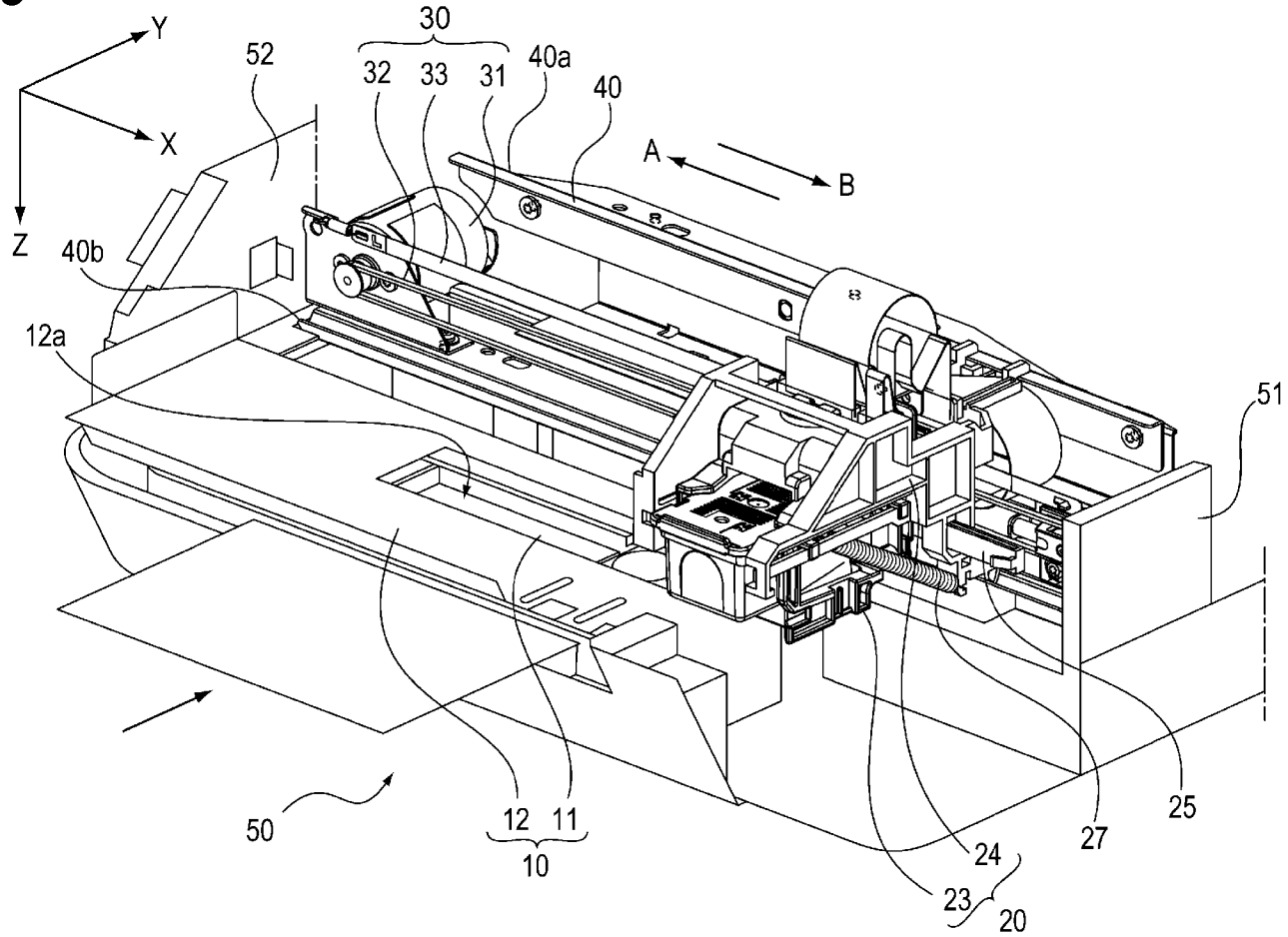
FIG. 3 is a perspective view showing a schematic configuration of the printer apparatus.
Figure 4:
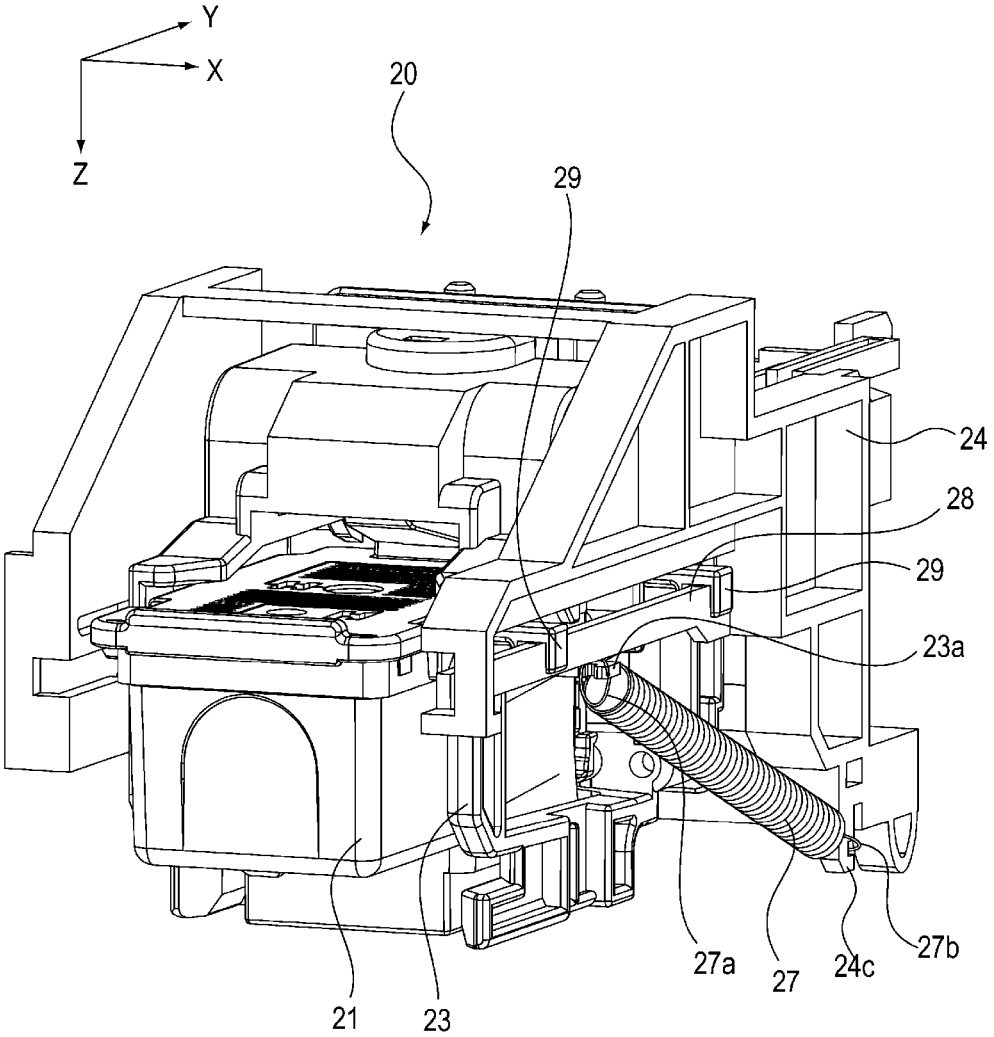
FIG. 4 is a perspective view of the scanning unit in the printer apparatus.
Figure 5:
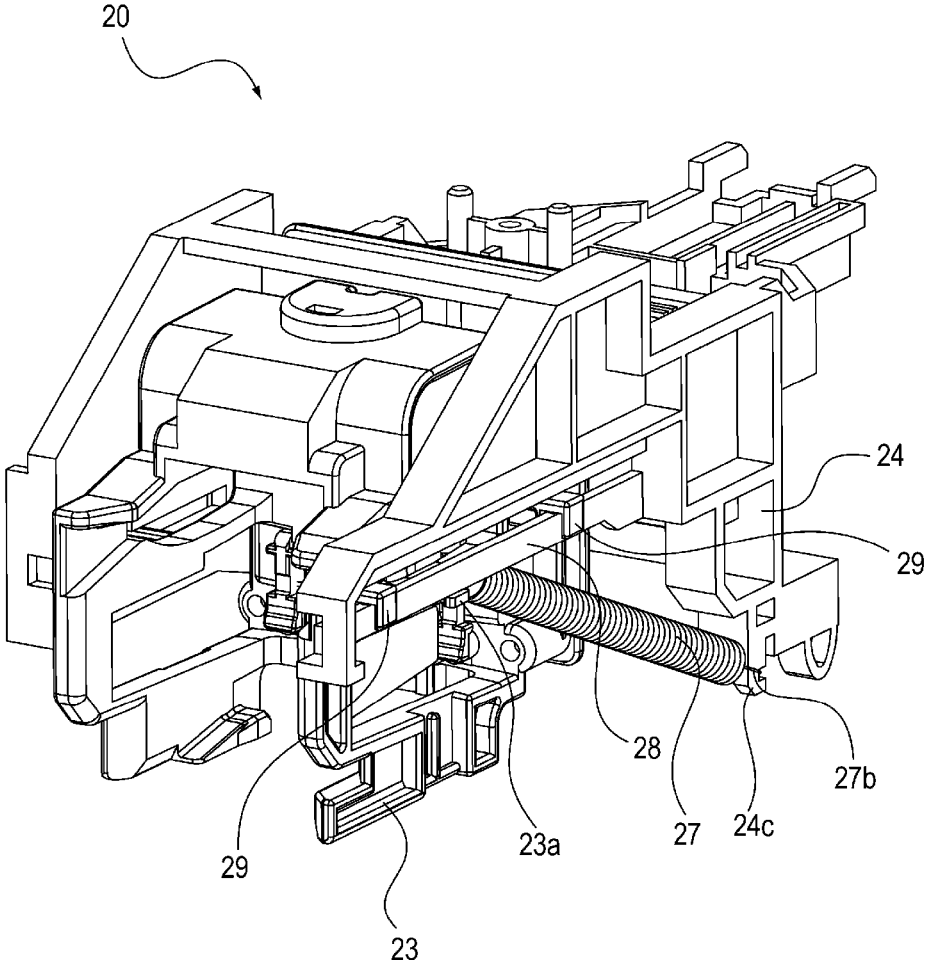
FIG. 5 is a perspective view of the scanning unit in the printer apparatus.
Figure 6:
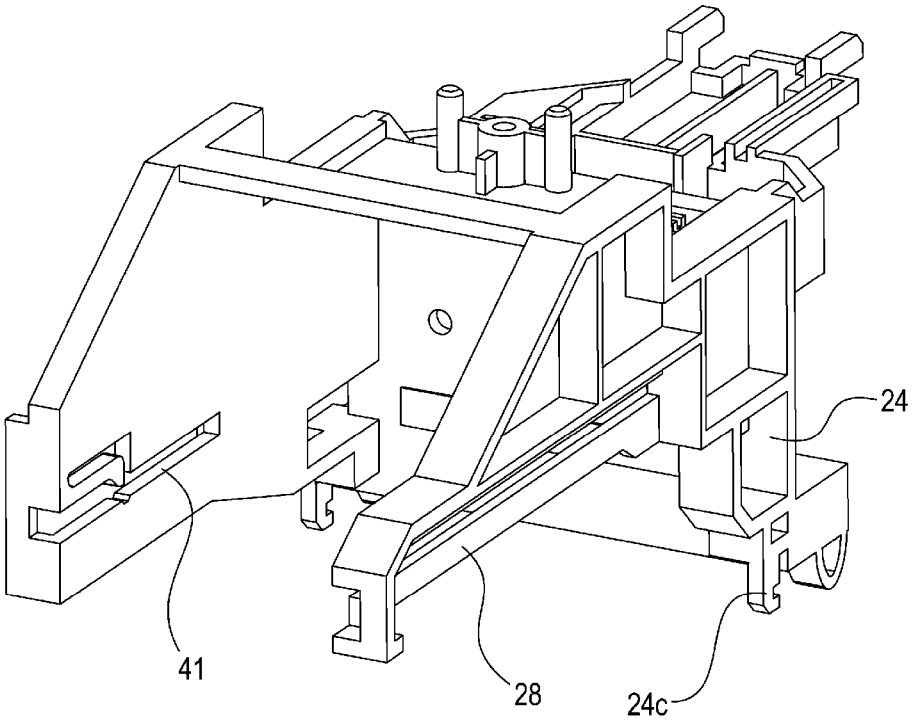
FIG. 6 is a perspective view of a carriage in the printer apparatus.
Figure 7B:
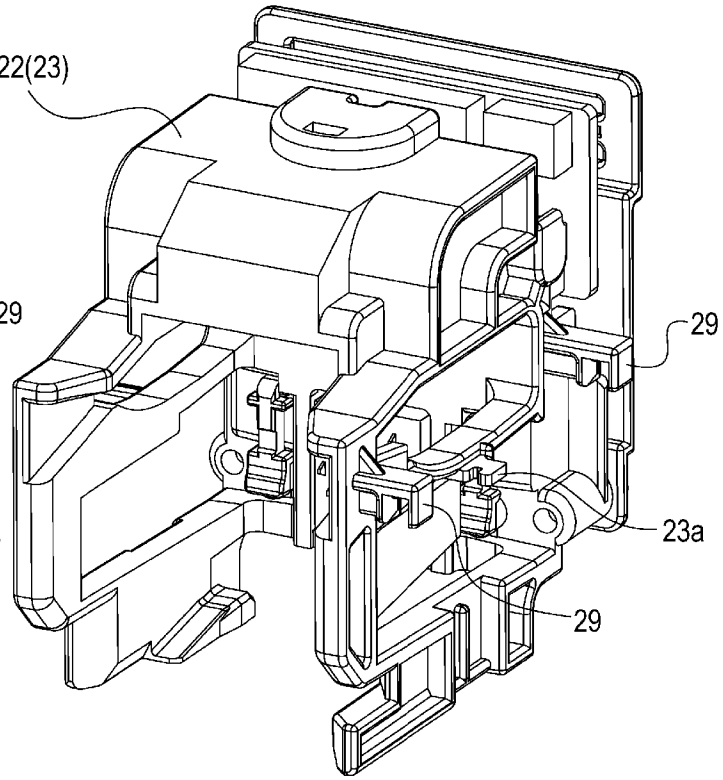
FIGS. 7A and 7B are perspective views of the carriage in the printer apparatus.
Figure 7A:
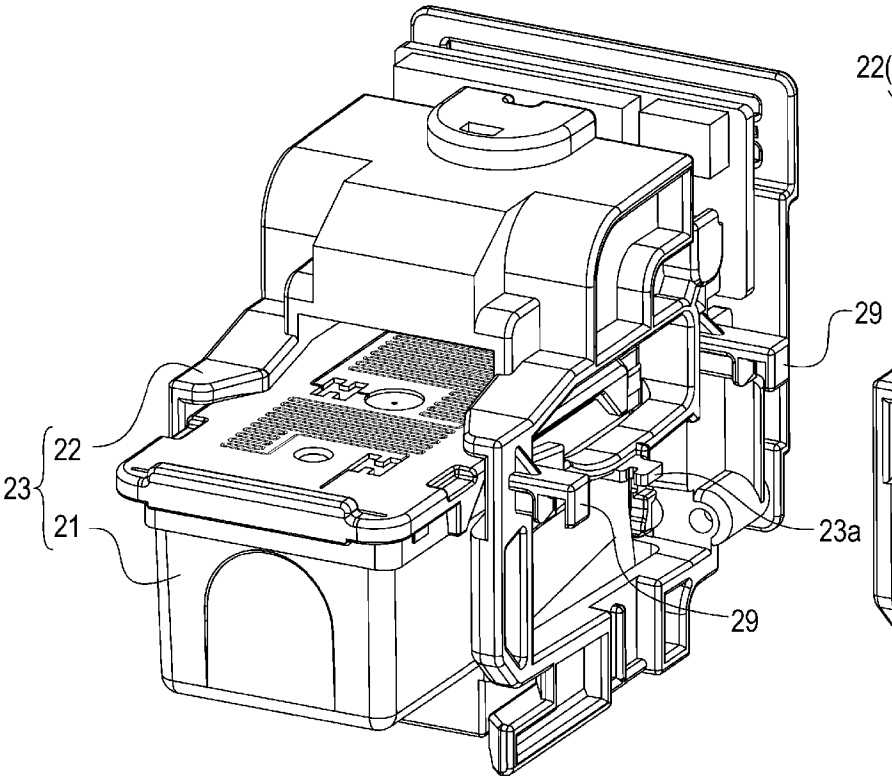
Figure 8:
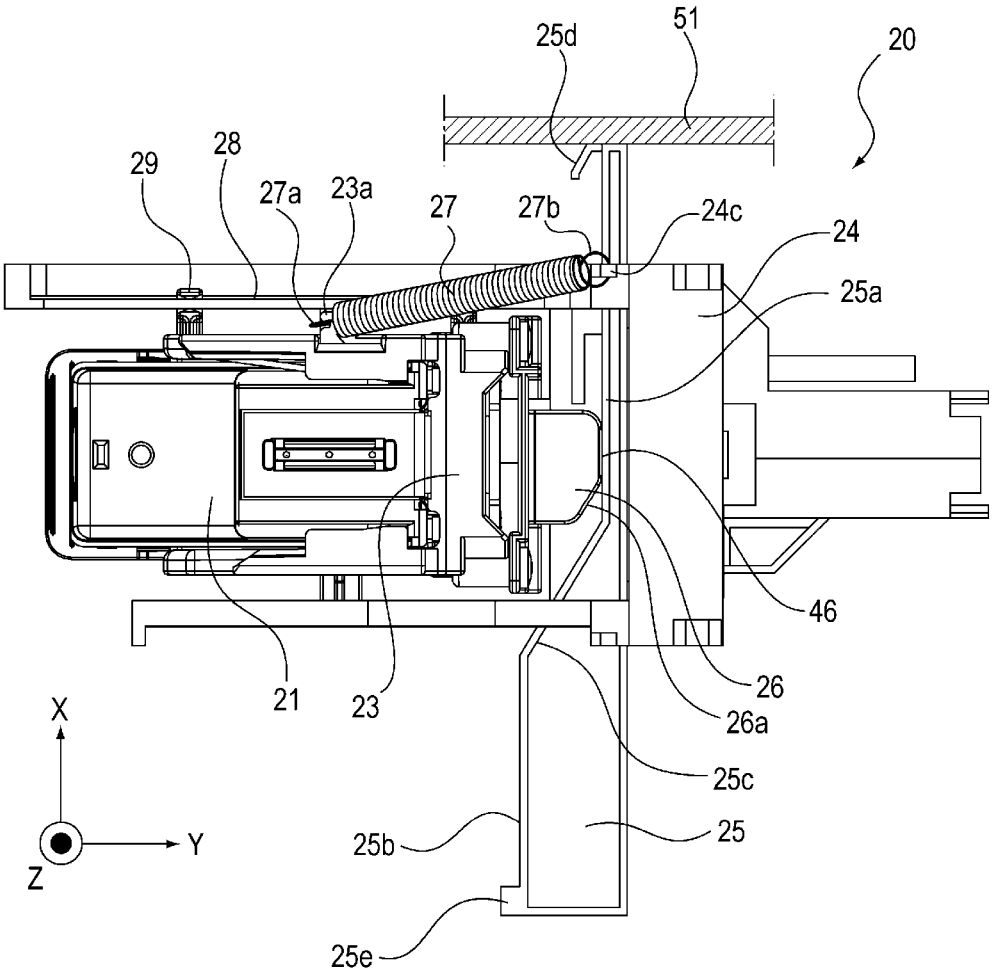
FIG. 8 is a view of the scanning unit in the printer apparatus as viewed the apparatus from the bottom.
Figure 9:
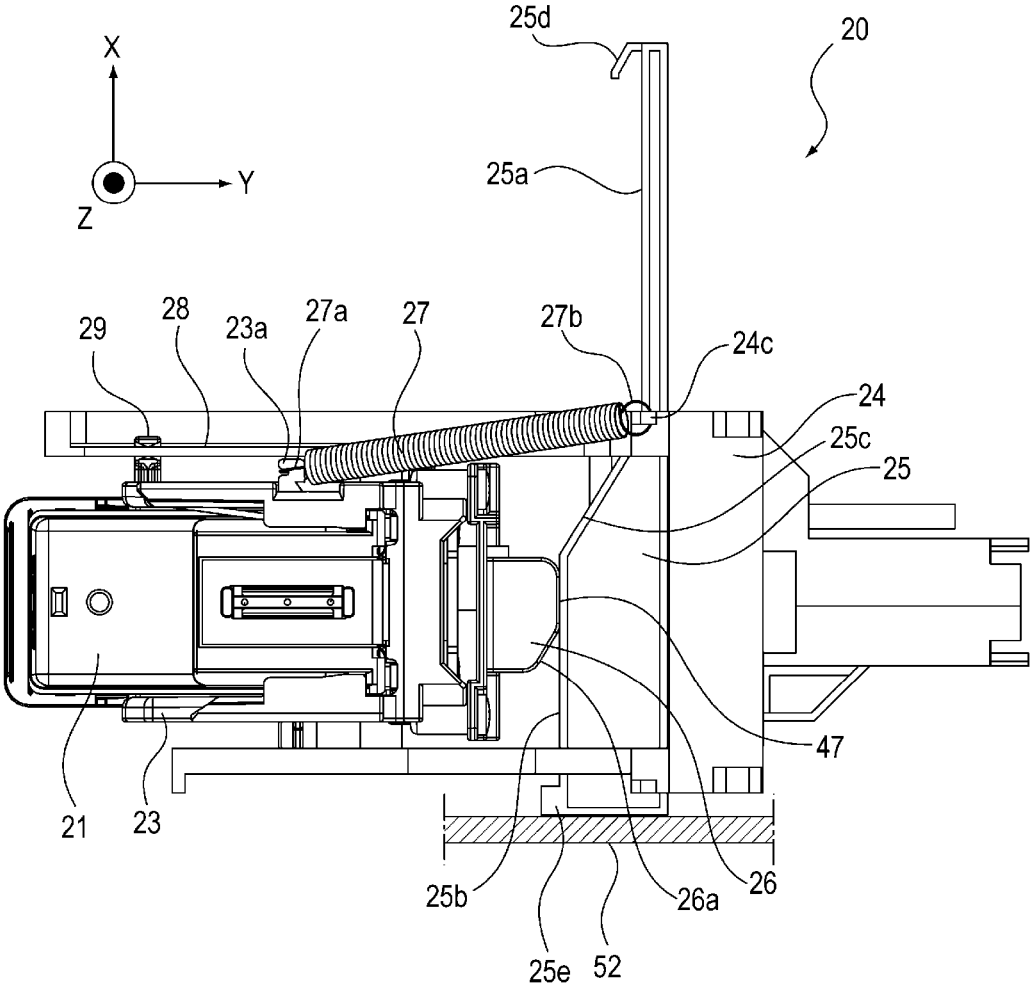
FIG. 9 is a view of the scanning unit in the printer apparatus as viewed the apparatus from the bottom.
Figure 10:
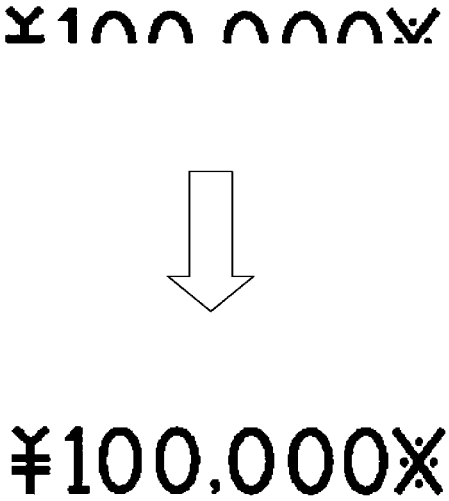
FIG. 10 is a view showing printed matter printed in two rows.

FIG. 1 is a side view of a scanning unit in the printer apparatus according to the present embodiment. FIG. 2 is a front view of the scanning unit according to the present embodiment. FIG. 3 is a perspective view showing a schematic configuration of the printer apparatus according to the present embodiment. FIG. 4 is a perspective view of the scanning unit, and is a perspective view showing a state in which a recording head is mounted. FIG. 5 is a perspective view of the scanning unit, and is a perspective view showing a carriage in a state in which the recording head is removed. FIG. 6 is a perspective view showing the carriage. FIG. 7A is a perspective view showing a sub-carriage in a state in which the recording head is mounted. FIG. 7B is a perspective view showing the sub-carriage in the state in which the recording head is removed. FIGS. 8 and 9 are perspective views showing the scanning unit in the printer apparatus as viewed the scanning unit from the bottom. FIG. 8 is a view showing a state in which a sub-carriage is positioned at a first position with respect to the carriage. FIG. 9 is a view showing the state in which the sub-carriage is positioned at the second position with respect to the carriage. FIG. 10 is a view showing printed matter printed in two rows As shown in FIG. 3, a printer apparatus 50 as the image forming apparatus records on a recording sheet as a recording medium while performing reciprocal scanning by the scanning unit 20 in a main scanning direction. The scanning unit 20 has a carriage 24, a sub-carriage 23 as a holding unit, a shift bar 25 as a moving member, and a tension coil spring 27 as a biasing member.

The carriage 24 is provided movably in the main scanning direction (first direction) with respect to the printer apparatus 50. The sub-carriage 23 is supported so as to be movable in the sub-scanning direction (second direction) which is substantially orthogonal to the main scanning direction with respect to the carriage 24.

the sub-carriage 23 as a holding unit detachably holds the recording head 21, FIG. 7A shows the state in which the recording head 21 is mounted, and FIG. 7B shows a state in which the recording head 21 is removed. As the carriage 24 reciprocates in the first direction, the sub-carriage 23 and the recording head 21 are moved in the first direction.

Here, the main scanning direction (first direction) is an X-axis direction shown in FIG. 3 and is a direction of an arrow A and a direction of an arrow B. The sub-scanning direction (second direction) is a direction substantially orthogonal to the main scanning direction and is a Y-axis direction shown in FIG. 3. A direction substantially orthogonal to the main scanning direction and the sub-scanning direction is a vertical direction (third direction) and is a Z-axis direction shown in FIG. 3.

In addition, in the present configuration, the recording head 21 as a recording unit uses an inkjet recording system which ejects ink to record an ink image on a recording sheet. That is, the recording head 21 includes an energy acting portion which is provided in a fine liquid ejection port (orifice), a liquid path, and a part of the liquid path, and an energy generating unit which generates liquid droplet forming energy to be applied to the liquid present in the acting portion. In addition, the recording head 21 includes an ink reservoir for accommodating ink.

As an ink ejection configuration according to the present embodiment, there is a configuration in which an electrothermal transducer is energized in response to a recording signal and ink is ejected from an ejection port by growth and shrinkage of bubbles occurring in the ink using film boiling generated in the ink due to heat energy thereof so as to perform recording.

As shown in FIGS. 1, 2, 6, and 7, the carriage 24 is provided with a guide rail 28 as a rail member which guides the sub-carriage 23 in the sub-scanning direction. The sub-carriage 23 is provided with a guide rail engaging portion 29 as a rail engaging portion which is engaged with the guide rail 28 so as to be movable in the sub-scanning direction along the guide rail 28. The sub-carriage 23 is movably held in the sub-scanning direction with respect to the carriage 24 by the engagement between the guide rail 28 and the guide rail engaging portion 29. In this case, the guide rail engaging portion 29 is provided at two sites in the Y-axis direction (second direction) which is the sub-scanning direction.

In this case, although the configuration in which the guide rail engaging portion 29 is configured to be provided at two sides in the Y-axis direction (the second direction) which is the sub-scanning direction is illustrated, but the present invention is not limited thereto.

In addition, as shown in FIGS. 4 and 5, the guide rail 28 and the guide rail engaging portion 29 are provided on one side of the carriage 24 and the sub-carriage 23 in the X-axis direction which is the main scanning direction. The guide rail 28 and the guide rail engaging portion 29 abuts on each other in the main scanning direction (X-axis direction) and in the vertical direction (Z-axis direction) by a biasing force and a self weight of the sub-carriage 23 which will be described later. In FIG. 2, an abutting portion in the main scanning direction of the guide rail 28 and the guide rail engaging portion 29 is denoted by reference numeral 45, and an abutting portion in the vertical direction of the guide rail 28 and the guide rail engaging portion 29 is denoted by reference numeral 44.

Further, as shown in FIG. 2, in the X-axis direction which is the main scanning direction, a guiding portion 41 and an engaging portion 42 engaging the guiding portion 41 are also provided on the other side of the carriage 24 and the sub-carriage 23. The guiding portion 41 is provided on the carriage 24. The engaging portion 42 is provided on the sub-carriage 23 and movably is engaged with the guiding portion 41 in the sub-scanning direction along the guiding portion 41. The guiding portion 41 and the engaging portion 42 abuts on each other in the vertical direction (Z-axis direction) by the self weight of the sub-carriage 23. In FIG. 2, the abutting portion of the guiding portion 41 and the engaging portion 42 in the vertical direction is denoted by reference numeral 43.

Further, the shift bar 25 (see FIGS. 8 and 9) as a moving member which moves the sub-carriage 23 as the holding unit supported by the carriage 24 to move the recording head 21 to the first position or the second position different from the first position in the sub-scanning direction (second direction). The recording head 21 ejects a liquid to the recording medium in a state in which the recording head 21 is positioned at the first position and in a state in which the carriage 24 is moved in the first direction (direction of arrow A) so as to perform the recording on the recording medium. In addition, as the sub-carriage 23 is moved by the shift bar (moving member) 25, the liquid is ejected to the recording medium in the state in which the recording head 21 is positioned at the second position and in the state in which the carriage 24 is moved in the first direction (direction of arrow B) so as to perform the recording on the recording medium. The first position and the second position of the sub-carriage 23 with respect to the carriage 24 are shown in FIGS. 8 and 9, respectively.

The shift bar 25 as the moving member has a first abutting surface 25*a* which abuts on the abutting portion 26 provided on the sub-carriage 23 to position the sub-carriage 23 at the first position shown in FIG. 8. In addition, the shift bar 25 has a second abutting surface 25*b* which abuts on the abutting portion 26 provided on the sub-carriage 23 to position the sub-carriage 23 at the second position shown in FIG. 9. The position of the second abutting surface 25*b* is different from the position of the first abutting surface 25*a* in the sub-scanning direction (second direction). In addition, in the shift bar 25, an inclined surface 25*c* inclined in the moving direction (main scanning direction) is provided between the first abutting surface 25*a* and the second abutting surface 25*b*. In addition, the abutting portion 26 of the sub-carriage 23 is also provided with the inclined surface 26*a* inclined similarly to the inclined surface 25*c* so that the inclined surface 26*a* faces the inclined surface 25*c*. As described above, the shift bar 25 is movably provided in the main scanning direction (first direction) with respect to the carriage 24 so that the first abutting surface 25*a* or the second abutting surface 25*b* is switched to abut on the abutting portion 26 of the sub-carriage 23.

It is to be noted that the abutting portion 26 of the sub-carriage 23 and the first abutting surface 25*a* or the second abutting surface 25*b* of the shift bar 25 abut on each other in the sub-scanning direction (Y-axis direction) by the biasing force to be described later. In FIG. 8, an abutting portion in the sub-scanning direction of the abutting portion 26 and the first abutting surface 25*a* is indicated by reference numeral 46. In FIG. 9, an abutting portion in the sub-scanning direction of the abutting portion 26 and the second abutting surface 25*b* is indicated by reference numeral 47.

The shift bar 25 is moved (moved in the direction of arrow B) toward one side in the main scanning direction (first direction) of the carriage 24, so that as shown in FIG. 8, one end portion of the shift bar 25 collides with one side wall (right side wall) 51 of the printer apparatus 50. As the carriage 24 is further moved after the collision with the side wall 51, the shift bar 25 is moved in a direction opposite to the moving direction of the carriage, a portion which abuts on the abutting portion 26 of the sub-carriage 23 is switched from the second abutting surface 25*b* to the first abutting surface 25*a* to abut thereon, and the sub-carriage 23 is moved to the first position shown in FIG. 8 with respect to the carriage 24. In addition, the shift bar 25 is moved (moved in the direction of arrow A) toward the other side in the main scanning direction of the carriage 24, so that as shown in FIG. 9, the other end portion of the shift bar 25 collides with the other side wall (left side wall) 52 of the printer apparatus 50. As the carriage 24 is further moved after the collision with the side wall 52, the shift bar 25 is moved in a direction opposite to the moving direction of the carriage 24, a portion which abuts on the abutting portion 26 of the sub-carriage 23 is switched from the first abutting surface 25*a* to the second abutting surface 25*b* to abut thereon, and the sub-carriage 23 is moved to the second position shown in FIG. 9 with respect to the carriage 24.

The shift bar 25 is provided with a detach-stop portion 25*d* at an end portion (an end portion on the side where the first abutting surface 25*a* is provided) on one side in the main scanning direction, and a detach-stop portion 25*e* at an end portion (an end portion on the side where the second abutting surface 25*b* is provided) on the other side in the main scanning direction. Therefore, even if the shift bar 25 is moved in the main scanning direction as described above, the shift bar 25 is not detached from the carriage 24.

In addition, as shown in FIGS. 1 and 3, the tension coil spring 27 as the biasing member is provided between the carriage 24 and the sub-carriage 23. The tension coil spring 27 applies a force to the sub-carriage 23 with respect to the carriage 24 in three directions of the main scanning direction, the sub-scanning direction, and a vertical direction substantially orthogonal to the main scanning direction and the sub-scanning direction. The tension coil spring 27 is provided on the side where the guide rail 28 and the guide rail engaging portion 29 are provided, that is, on one side in the main scanning direction of the carriage 24 and the sub-carriage 23. The tension coil spring 27 will be described later.

As shown in FIG. 3, in addition to the scanning unit 20, the printer apparatus 50 has a feeding lifter portion 10 for setting the recording medium at the time of printing. In addition, the printer apparatus 50 includes a carriage driving portion 30 which reciprocates the scanning unit 20 in the main scanning direction, a rail guide portion 40 which guides the carriage 24 of the scanning unit 20 in the main scanning direction, and the like.

In FIG. 3, the feeding lifter portion 10 has a recording sheet stacking member 11 and a platen member 12. The recording sheet stacking member 11 is configured to be movable in a perpendicular direction (vertical direction, Z-axis direction) towards the recording head 21 by an elevation motor (not shown) between a set position for stacking the recording sheet and a recordable position performing recording on the set recording sheet. The recording sheet stacking member 11 is lifted up from the set position to the recordable position by allowing a detection sensor (not shown) to detect a user's sheet insertion operation. In addition, the platen member 12 is provided above the recording sheet stacking member 11, and the platen member 12 has an opening 12*a* through which the ink discharged from the recording head 21 passes. The platen member 12 becomes a recording sheet fixing unit during recording which can abut the recording sheet on the surface and press the recording sheet by pressing the recording sheet with a fixed pressing force by the recording sheet stacking member 11 regardless of a thickness of the recording sheet.

Next, the carriage driving portion 30 which makes the recording head 21 perform reciprocal scanning will be described. The carriage driving portion 30 in the printer apparatus 50 includes a motor 31 that moves the recording head 21 and a driving belt 32 that transmits a driving force of the motor 31. The carriage 24 constituting the scanning unit 20 is fixed to a part of the driving belt 32. The driving belt 32 is driven by the forwardly reversing motor 31 so that the carriage 24 reciprocates in directions of arrows A and B shown in FIG. 3, and interlocks with the carriage 24 to reciprocate the recording head 21 in the main scanning direction. Although the DC motor is used as the motor 31 in this embodiment, any unit capable of transmitting a power source to the belt such as a stepping motor may be used.

The sub-carriage 23 has a control board which makes contact with a conducting portion provided in the recording head 21 and communicates with a controller through the conducting portion, and thus transmits a mounting state of the recording head 21 and the like to the controller (not shown). The controller (not shown) controls the overall operation of the printer apparatus 50. The controller includes a CPU, a ROM, a RAM, and the like.

In order to guide an operation path at the time of performing reciprocal scanning by the carriage 24, the printer apparatus 50 is provided with the rail guide portion 40 as described above. The rail guide portion 40 holds an attitude of the carriage 24 by making engaging portions 24*a* and 24*b* as predetermined portions of the carriage 24 engage with an upper part 40*a* and a lower part 40*b* of the rail guide portion 40, respectively (FIG. 1). The carriage 24 which receives the driving force from the carriage driving portion 30 moves in the main scanning direction, and ink is ejected from the recording head 21 at timing when the carriage 24 passes through an upper part of the recording sheet set by the feeding lifter portion 10 to form an image.

To perform the reciprocating scanning of the scanning unit 20 and the recording operation by the recording head 21, a position detection unit of the carriage 24 is required. For this reason, a linear encoder 33 is disposed on an operation area (moving area) of the carriage 24 (FIG. 3), and a linear encoder reading unit 34 provided on the scanning unit 20 side detects the operation position of the carriage 24 in the main scanning direction.

Although the configurations of the linear encoder 33 as the position detection unit and a photosensor 34 as the linear encoder reading unit are exemplified in this embodiment, the configurations are not limited thereto. For example, as a substitute for the linear encoder, any unit having a position detection function such as a rotary encoder, a stepping motor, and a transmission type sensor can be used as the position detection unit.

Here, the tension coil spring 27 as a biasing member which applies a force to the sub-carriage 23 supported by the carriage 24 in a predetermined direction so as to position the sub-carriage 23 will be described. As shown in FIGS. 4 and 5, the sub-carriage 23 is provided with a first locking portion 23*a* which locks one end portion 27*a* of the tension coil spring 27. The carriage 24 is provided with a second locking portion 24*c* which locks the other end portion 27*b* of the tension coil spring 27. The tension coil spring 27 is locked between the carriage 24 and the sub-carriage 23 by the first locking portion 23*a* and the second locking portion 24*c*.

The first locking portion 23*a* of the sub-carriage 23 is provided at different positions from the second locking portion 24*c* of the carriage 24 in each direction of the main scanning direction (first direction), the sub-scanning direction (second direction), and the vertical direction (third direction).

Specifically, as shown in FIGS. 8 and 9, the first locking portion 23*a* is provided at a position which is shifted toward a side close to the sub-carriage 23 with respect to the second locking portion 24*c* in the X-axis direction as the main scanning direction. The first locking portion 23*a* is provided on one side of the tension coil spring 27 and the second locking portion 24*c* is provided on the other side thereof in the X-axis direction as the main scanning direction via the engaging portion between the guide rail 28 and the guide rail engaging portion 29. As a result, the guide rail engaging portion 29 is pressed against the guide rail 28 in the main scanning direction (X-axis direction) by a component force in the X-axis direction in the biasing force of the tension coil spring 27. Here, since the guide rail engaging portion 29 moves while receiving a sliding resistance by the guide rail 28, the efficiency of the biasing force is improved by providing the locking portion of the tension coil spring 27 on an end of the sub-carriage 23 and the carriage 24 on which the guide rail engaging portion 29 and the guide rail 28 are disposed.

In addition, as shown in FIGS. 8 and 9, the first locking portion 23*a* is provided at a position which is shifted toward a side close to the recording head 21 with respect to the second locking portion 24*c* in the Y-axis direction as the main scanning direction. As a result, the abutting portion 26 of the sub-carriage 23 is pressed against the shift bar 25 in the sub-scanning direction (Y-axis direction) by a component force in the Y-axis direction in the biasing force of the tension coil spring 27.

In addition, as shown in FIGS. 1 and 2, the first locking portion 23*a* is provided at a position which is shifted to the upper side of the apparatus with respect to the second locking portion 24*c* in the Z-axis direction as the vertical direction. As a result, the guide rail engaging portion 29 is pressed against the guide rail 28 in the vertical direction (Z-axis direction) by a component force in the Z-axis direction in the biasing force of the tension coil spring 27. In the vertical direction, a gravitational force due to a self weight of the sub-carriage 23 to the carriage 24 also acts on the pressing described above.

In this way, the first locking portion 23*a* is provided at different positions from the second locking portion 24*c* in the main scanning direction, the sub-scanning direction, and the vertical direction. As a result, by one tension coil spring 27 as a biasing member, a force can be applied to the sub-carriage 23 so that the sub-carriage 23 can be positioned in three directions (three axial directions) substantially orthogonal to each other with respect to the carriage 24.

As described above, according to the present embodiment, by the tension coil spring 27 as one biasing member, the sub-carriage 23 can be applied with a force in three directions substantially orthogonal to each other with respect to the carriage 24. As a result, even when a speed change occurs in the carriage 24, it is possible to alleviate rattling of the sub-carriage 23 within the carriage 24, thereby more improving the recording accuracy than the prior art.

In the present apparatus, for the main purpose of the recording, a bar code and related characters in a predetermined area (here, 1 inch area) are used, and the recording area of the recording head 21 held by the sub-carriage 23 is approximately ½ width (here, 0.5 inch width) of a predetermined area. Therefore, in the configuration of the present apparatus, for the recording of the predetermined area, there is a need to perform recording operations corresponding to two rows of recording by being dividing into a forward path and a return path of the scanning unit 20. FIG. 10 shows an example of printed matter on which two rows are printed.

More specifically, when the recording operation is started, the carriage 24 performs scanning in the direction of the arrow A shown in FIG. 3, and a recording operation of a first row is performed on the recording sheet. Next, an end portion of the shift bar 25 abuts on a side wall (left side wall) 52 of the apparatus and the carriage 24 is moved after the abutting on the side wall 52, so that the sub-carriage 23 is shifted in the Y-axis direction along an external form of the shift bar 25 and is moved from a first position shown in FIG. 8 to a second position shown in FIG. 9 and the carriage 24 performs scanning in the direction of the arrow A ends at the predetermined position.

After the scanning in the direction of the arrow A ends, the carriage 24 performs scanning in the direction of the arrow B shown in FIG. 3, and a recording operation of a second row is performed on the recording sheet. Next, the end portion of the shift bar 25 abuts on a side wall (right side wall) 51 of the apparatus and the carriage 24 is moved after the abutting on the side wall 51, so that the sub-carriage 23 is shifted in the Y-axis direction along an external form of the shift bar 25 and is moved from the second position shown in FIG. 9 to the first position shown in FIG. 8 and the carriage 24 performs scanning in the direction of the arrow B ends at the predetermined position.

The printed recording sheet is taken out in a forward direction of the printer apparatus 50 by a user after the descending of the recording sheet stacking member 11, and a series of printing operations end.

As described above, according to the present embodiment, by the tension coil spring 27 as the single biasing member, the sub-carriage 23 can be applied with a force in three directions substantially orthogonal to each other with respect to the carriage 24. As a result, even when a speed change such as a sudden stop or a sudden acceleration in the carriage 24 occurs, the sub-carriage 23 can be prevented from rattling within the carriage 24, and the recording accuracy of the recording head 21 held by the sub-carriage 23 can be improved.

Second Embodiment

In the first embodiment, the sub-carriage is applied with a force in three directions substantially orthogonal to each other with respect to the carriage by one biasing member (tension coil spring 27), but in the second embodiment, the one biasing member (tension coil spring 27) is not used and two types of biasing members (the first biasing member and the second biasing member) are disposed in consideration of the sub-scanning direction in which the moving area is wide and the main scanning direction and the vertical direction in which the moving area is narrow other than the sub-scanning direction so as to move the sub-carriage.

Figure 11:
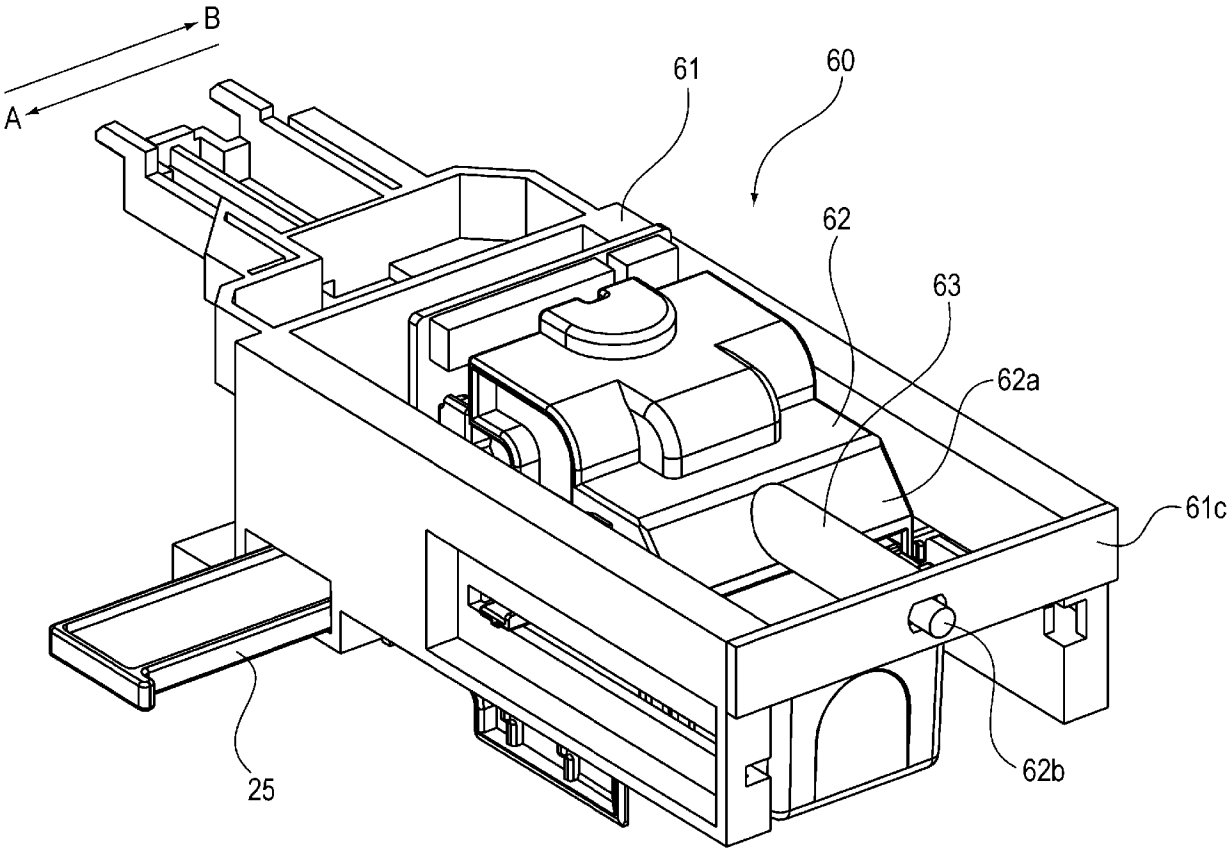
FIG. 11 is a perspective view of a scanning unit according to a second embodiment.
Figure 12:
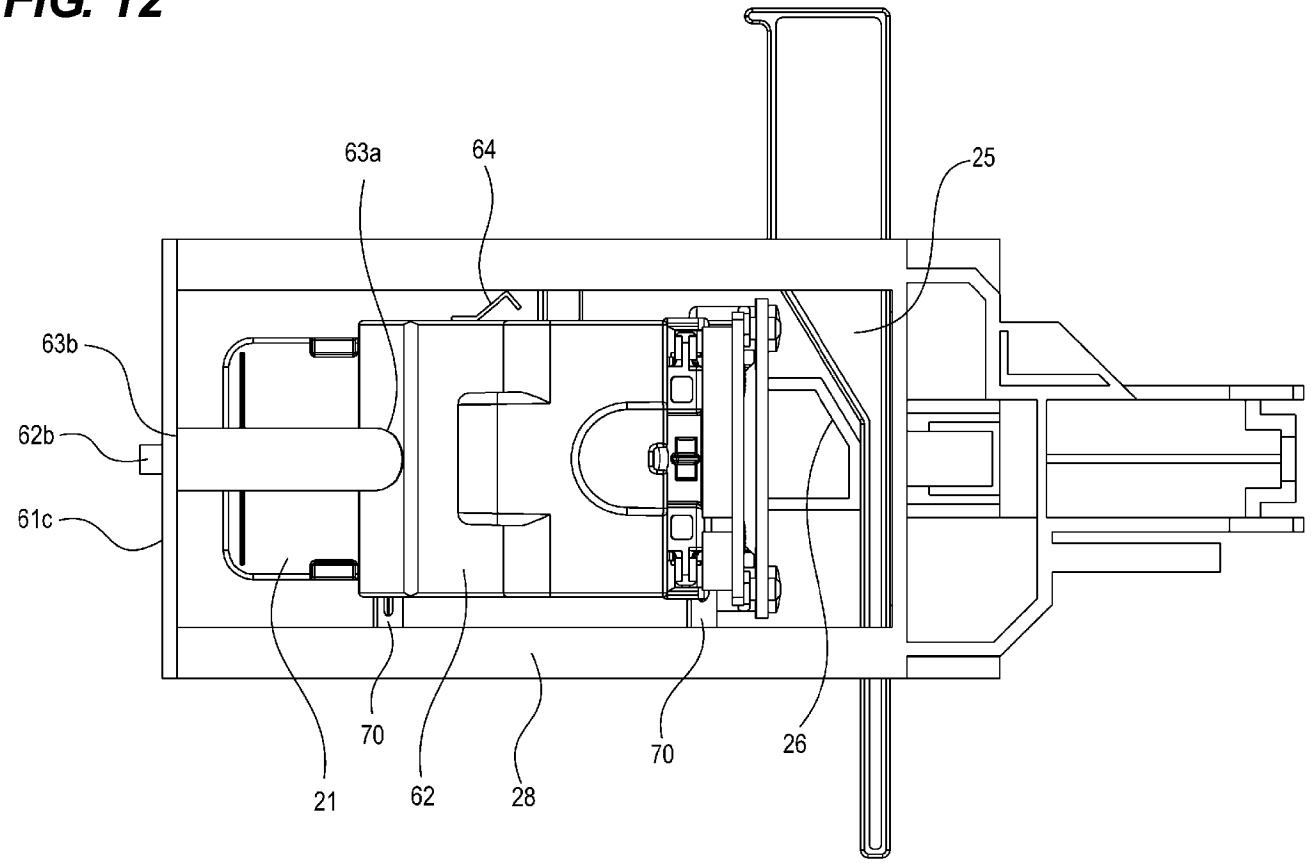
FIG. 12 is a top view of the scanning unit according to the second embodiment.

The embodiment of the present invention will be described in detail with reference to FIGS. 11 and 12. FIG. 11 is a perspective view showing a scanning unit in a state in which a recording head according to the second embodiment of the present invention is mounted. FIG. 12 is a top view showing the scanning unit in the state in which the recording head according to the second embodiment of the present invention is mounted.

In the second embodiment, a first biasing member which applies a force to a sub-carriage in two directions of a vertical direction (third direction) and a sub-scanning direction (second direction), and a second biasing member which applies a force to the sub-carriage in a main scanning direction (first direction) are disposed. As in the first embodiment, the first direction, the second direction, and the third direction are three directions substantially orthogonal to each other.

A scanning unit 60 according to the second embodiment includes a carriage 61, a sub-carriage 62 as a holding unit, a shift bar 25 as a moving member, a compression coil spring 63 as a first biasing member, and a leaf spring 64 as a second biasing member.

Similar to the first embodiment, the shift bar 25 is a moving member which moves the sub-carriage 62 as the holding unit supported by the carriage 61 to move the recording head 21 to the first position or the second position different from the first position in the sub-scanning direction (second direction). The recording head 21 ejects a liquid to the recording medium in a state in which the recording head 21 is positioned at the first position and in a state in which the carriage 61 is moved in the first direction (direction of arrow A) so as to perform the recording on the recording medium. In addition, as the sub-carriage 62 is moved by the shift bar (moving member) 25, the liquid is ejected to the recording medium in the state in which the recording head 21 is positioned at the second position and in the state in which the carriage 61 is moved in the first direction (direction of arrow B) so as to perform the recording on the recording medium.

Here, the first biasing member and the second biasing member which applies a force to the sub-carriage 62 supported by the carriage 61 in a predetermined direction to position the sub-carriage 62 will be described.

The sub-carriage 62 is provided with a first locking portion 62*a* which locks one end portion 63*a* of the compression coil spring 63 as the first biasing member. The first locking portion 62*a* is an inclined surface in which a surface orthogonal to the sub-scanning direction (second direction) is inclined by a predetermined angle toward a lower side in the vertical direction (third direction). The carriage 61 is provided with a second locking portion 61*c* which locks the other end portion 63*b* of the compression coil spring 63. The second locking portion 61*c* is an inner wall surface orthogonal to the second direction. Therefore, the compression coil spring 63 as the first biasing member applies a force to the sub-carriage 62 in the second direction for the carriage 61 and the third direction by the first locking portion 62*a* and the second locking portion 61*c*. The first locking portion 62*a* of the sub-carriage 62 is provided with a spring guide boss 62*b* which is toward the second locking portion 61*c* of the carriage 61, and the compression coil spring 63 is disposed by being guided by the spring guide boss 62*b*.

The leaf spring 64 as the second biasing member is a leaf spring which is disposed on an inner wall of the sub-carriage 62 and applies a force to an outer wall of the opposing carriage 61 in the first direction. The sub-carriage 62 is applied with a force toward a guide rail 28 side of the sub-carriage 62 by the leaf spring 64, and an abutment guide boss 70 of the sub-carriage 62 abuts against the guide rail 28.

As described above, the sub-carriage 62 can be applied with a force in three directions substantially orthogonal to each other with respect to the carriage 61 by the first biasing member and the second biasing member. As a result, even when a speed change such as a sudden stop or a sudden acceleration in the carriage 61 occurs, the sub-carriage 62 can be prevented from rattling within the carriage 61, and the recording accuracy of the recording head 21 held by the sub-carriage 62 can be improved.

In the first and second embodiments described above, the case of the inkjet recording apparatus using one recording head as the image forming apparatus has been exemplified, but the present invention is not limited thereto. For example, an inkjet recording apparatus for gradation recording using a plurality of recording heads which performs recording with different color inks, or an inkjet recording apparatus for gradation recording using a plurality of recording heads which performs recording with ink of the same color and different density, and the like can be used. In addition, regardless of the number of recording heads, any inkjet recording apparatus can be similarly applied and can achieve the same operation and effect.

In addition, as a recording unit (recording head), a cartridge type recording unit in which a recording head and an ink reservoir are integrated, a recording unit having a structure in which the recording head and the ink reservoir are separated from each other and are connected to each other by an ink supply tube or the like may be used. Regardless of the structure of the recording unit, any recording unit can be similarly applied and can achieve the same effect.

In addition, when the present invention is applied to the inkjet recording apparatus, it can be applied to, for example, an apparatus using a recording unit using an electromechanical transducer such as a piezo element or the like. Above all, an excellent effect can be obtained in an inkjet recording apparatus using a recording unit of a system for ejecting ink using thermal energy. According to the system, high density and high definition of recording can be achieved.

In addition, the form of the inkjet recording apparatus described above is used as an image output terminal device of an information processing device such as a computer. In addition, the inkjet recording apparatus may take a form of an inkjet input/output apparatus capable of attaching a scanner or the like other than the recording head to the carriage, a copying device combined with a reader or the like, or a facsimile machine having a transmission/reception function, and the like.

In addition, in the above-described embodiment, the inkjet recording system has been exemplified as the recording system, but the present invention is not limited thereto, and other recording systems such as a thermal transfer recording system and a thermal recording system may be applied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-249531, filed Dec. 26, 2017, Japanese Patent Application No. 2018-237720, filed Dec. 19, 2018 which are hereby incorporated by reference herein in their entirety.

What is claimed is:

1. An image forming apparatus, comprising:

a recording head which performs recording on a recording medium by ejecting a liquid to the recording medium;

a carriage which moves the recording head in a first direction by reciprocating in the first direction; and a holding unit which detachably holds the recording head, wherein the holding unit is supported by the carriage, and the holding unit is moved in a second direction substantially orthogonal to the first direction while being supported by the carriage to move the recording head between a first position and a second position different from the first position, the holding unit and the recording head is movable in the first direction together with the carriage, the recording head ejects a liquid to the recording medium in a state in which the recording head is positioned at the first position and in a state in which the carriage is moved in the first direction so as to perform the recording on the recording medium, the recording head ejects a liquid to the recording medium in a state in which the recording head is positioned at the second position and in a state in which the carriage is moved in the first direction so as to perform the recording on the recording medium, the image forming apparatus further comprises:

a biasing member which applies a force to the holding unit supported by the carriage in a predetermined direction with respect to the carriage so as to position the holding unit, a first locking portion which is provided on the holding unit to lock one end portion of the biasing member; and a second locking portion which is provided on the carriage to lock the other end portion of the biasing member, wherein the second locking portion is at different positions from the first locking portion in the first direction, the second direction, and a third direction, and the third direction is substantially orthogonal to the first direction and the second direction.

2. The image forming apparatus according to claim 1, wherein the first locking portion is disposed over the second locking portion in the third direction.

3. The image forming apparatus according to claim 1, further comprising:

a rail member which is provided on the carriage and guides the holding unit in the second direction; and a rail engaging portion which is provided in the holding unit and is movably engaged with the rail member in the second direction along the rail member.

4. The image forming apparatus according to claim 3, wherein the rail member and the rail engaging portion are provided on one end of the cartridge and holding unit in the first direction, and the first locking portion and the second locking portion are provided on the one end.

5. The image forming apparatus according to claim 1, further comprising:

a moving member which moves the holding unit between positions corresponding to each of the first position and the second position with respect to the carriage.

6. The image forming apparatus according to claim 5, wherein the moving member includes a first abutting surface which abuts on the holding unit and holds the holding unit at a position corresponding to the first position, and a second abutting surface which abuts on the holding unit, holds the holding unit at a position corresponding to the second position, and is different from the first abutting surface in a position in the second direction, and the moving member is movably provided in the first direction with respect to the holding unit so that the first abutting surface or the second abutting surface is switched to abut on the holding unit.

7. The image forming apparatus according to claim 5, wherein the biasing member presses the holding unit in the second direction with respect to the moving member.

8. An image forming apparatus, comprising:

a recording head which performs recording on a recording medium by ejecting a liquid to the recording medium;

a carriage which moves the recording head in a first direction by reciprocating in the first direction; and a holding unit which detachably holds the recording head, wherein the holding unit is supported by the carriage, and the holding unit is moved in a second direction substantially orthogonal to the first direction while being supported by the carriage to move the recording head between a first position and a second position different from the first position, the holding unit and the recording head is movable in the first direction together with the carriage, the recording head ejects a liquid to the recording medium in a state in which the recording head is positioned at the first position and in a state in which the carriage is moved in the first direction so as to perform the recording on the recording medium, the recording head ejects a liquid to the recording medium in a state in which the recording head is positioned at the second position and in a state in which the carriage is moved in the first direction so as to perform the recording on the recording medium, the image forming apparatus further comprises:

a first biasing member which applies a force to the holding unit supported by the carriage in a predetermined direction with respect to the carriage so as to position the holding unit;

a first locking portion which is provided on the holding unit to lock one end portion of the first biasing member;

a second locking portion which is provided on the carriage to lock the other end portion of the first biasing member, wherein the second locking portion are at different positions from the first locking portion in the second direction and a third direction, the third direction is substantially orthogonal to the first direction and the second direction, and a second biasing member which applies a force to the holding unit in the first direction with respect to the carriage so as to position the holding unit.

* * * * *